United States Patent [19]

Gates

[11] Patent Number: 4,743,368

[45] Date of Patent: May 10, 1988

[54] SWIMMING POOL SKIMMING AND VACUUMING SYSTEM

[76] Inventor: Harvey W. Gates, P.O. Box 40, Bloomington, Calif. 92316

[21] Appl. No.: 915,708

[22] Filed: Oct. 6, 1986

[51] Int. Cl.[4] ..... E04H 3/20

[52] U.S. Cl. ..... 210/163; 210/169; 210/416.2; 210/136; 4/490

[58] Field of Search ..... 210/169, 117, 136, 416.2, 210/242.1, 242.3; 4/490; 15/1.7

[56] References Cited

U.S. PATENT DOCUMENTS

| | | | |
|---|---|---|---|
| 3,067,879 | 12/1962 | Baker | 210/169 |
| 3,186,550 | 6/1965 | Beduhn | 210/169 |
| 3,212,268 | 10/1965 | Ortega | 210/169 |
| 3,306,448 | 2/1967 | Baker | 210/169 |
| 3,616,918 | 11/1971 | Diemond | 210/169 |
| 3,620,372 | 8/1969 | Ehret | 210/169 |
| 3,868,319 | 2/1975 | Black et al. | 210/169 |
| 4,348,281 | 9/1982 | Perry et al. | 210/169 |

*Primary Examiner*—Richard V. Fisher
*Assistant Examiner*—Coreen Y. Lee
*Attorney, Agent, or Firm*—Harvey S. Hertz

[57] ABSTRACT

A swimming pool skimming and vacuuming system includes a passage plate for insertion in the passage interconnecting a pool filter to a pool. The passage plate has a skimmer weir positioned therein for drawing off scum from the upper surface of pool. An aperture is formed in the plate for enabling automatic vacuuming of the pool while simultaneously enabling skimmer weir action to occur. A weir basket is positioned in the skimmer well for collecting scum from the weir. A top mounting plate is secured in the skimmer well and contains a basket opening therein for enabling the top surface of the basket to be positioned in the plate. A hose opening is formed in the plate for enabling the vacuum hose to be connected thereto. A regulator valve is coupled to the pool suction pump for enabling the suction between the vacuum hose and the weir basket to be adjustably controlled.

7 Claims, 3 Drawing Sheets

SWIMMING POOL SKIMMING AND VACUUMING SYSTEM

BACKGROUND OF THE INVENTION (1) Field of the Invention

The field of art to which the invention pertains includes the field of pool skimming systems and, more particularly, to a swimming pool skimming system which enables simulataneous skimmer weir action and vacuuming of a pool to occur.

(2) Description of the Prior Art

In conventional swimming pool skimming and vacuuming systems, it is normally necessary to disconnect the skimmer weir from operation when an automatic vacuuming system is utilized. Typically, the weir is positioned in the horizontal or non-operative position and the vacuum hose is placed over the top surface of the weir and connected to the pool vacuuming system. In the horizontal position, of course, the weir is non-operative. Alternatively, the weir is completely by-passed as the hose is inserted into the vacuuming system from the top of the pool. In either of these two instances, normally, the weir is non-operative.

Known prior art includes U.S. Pat. Nos. 3,856,679; 3,169,920; 3,575,729; 3,443,264; 3,481,470; 2,980,256; 3,928,202 and 3,567,020.

SUMMARY OF THE INVENTION

A swimming pool skimming and vacuuming system includes a passage plate for insertion in the passage interconnecting a pool skimmer well to a pool. The passage plate has a skimmer weir positioned adjacent thereto for drawing off scum from the upper surface of the pool water. An aperture is formed in the plate for interconnecting a pool vacuum cleaning hose therethrough for enabling automatic vacuuming of the pool and simultaneously enabling skimmer weir action to occur. A weir basket is positioned in the skimmer well for collecting scum from the weir. A top mounting plate is secured in the skimmer well which contains a basket opening position therein for enabling the top surface of the basket to be positioned in the top mounting plate. The hose opening is formed in the plate for enabling the vacuum hose to be connected thereto. A regulator valve is coupled to a pool suction pump for adjusting the amount of suction to the vacuum hose and weir basket.

The advantages of this invention both as its construction and mode of operation will be readily appreciated when the same becomes better understood with respect to the accompanying drawings in which like reference numerals indicate like parts throughout the figures.

DESCRIPTION OF THE PREFERRED EMBODIMENT

Figure 1:
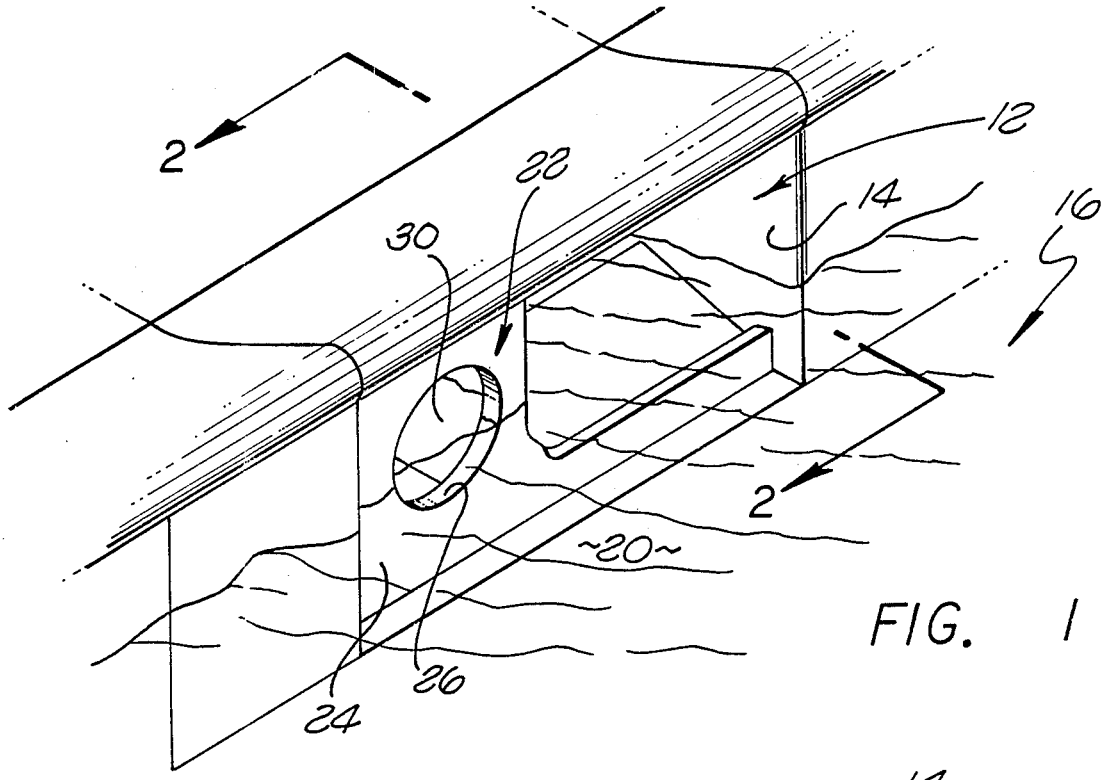
FIG. 1 is a perspective view of the swimming pool weir.
Figure 2:
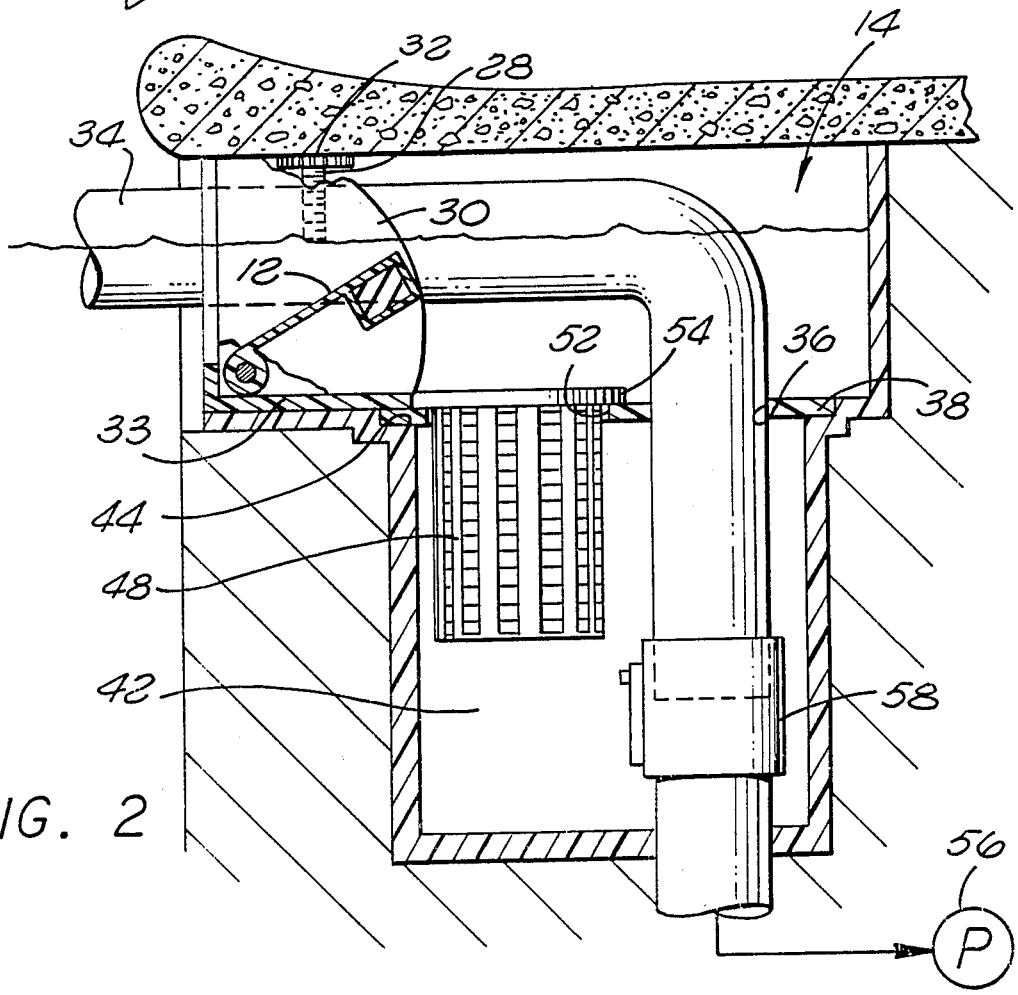
FIG. 2 is a cross-sectional view taken along the line 2—2 of FIG. 1.

Referring now to the drawings, there is shown in FIG. 1, a modified swimming pool skimmer weir 12 used in the swimming pool skimming and vacuuming cleaning system constructed in accordance with principles of the invention. The system of FIG. 1 utilizes the modified skimmer weir 12 which is positioned in the passage 14 interconnecting a pool 16 to a skimmer well 42 (FIG. 2). In normal operation, the water 20 entering the passage 14 operates to skim debris and scum in the pool into the skimmer well 42 via the skimmer weir 12. The present invention includes a passage plate 22 which is mounted transverse of the passage 14. The passage plate 22 includes the pivoting skimmer weir 12 and a fixed plate portion 24 having a central aperture 26 formed therein. Thus, while the skimmer weir 12 continues to operate in its conventional manner, a vacuum hose (not shown) can be inserted through the central aperture 26 to enable skimming to continue to occur while automatic vacuuming of the pool is simultaneously performed as will be explained hereinafter.

As can be seen, the passage plate 22 is fitted almost across the entire cross section of the passage 14. In normal installation, the conventional weir in the pool would be removed or the present passage plate 22 could be, of course, installed in an initial pool filtering installation.

As shown in FIG. 2, the fixed plate portion 24 remains in a vertical position by means of a adjustable screw 28 secured to a divider 30. The screw 28 has a top surface 32 which abuts the top surface of the passage 14. The bottom support portion 33 of the passage plate 22 can lock into the pivot mechanism of the conventional weir which normally was previously mounted across the entire bottom length of the passage 14.

Adjacent the fixed plate portion 24, is the modified skimmer weir 12 of the present invention. While, of course, the skimmer weir 12 is of a smaller cross-sectional dimension than the normal skimmer weir width in such a construction, the present invention enables simultaneous use of a vacuum hose which passes through the aperture 26 of the fixed plate 24. However, it has been found that the reduced width skimmer weir 12 performs almost as well in skimming action as does a conventional full width skimmer weir.

A vacuum hose 34 extends through the central aperture 26 of the passage plate 22, and passes through an opening 36 in a top plate 38 which is positioned over the skimmer well 42. The top plate 38 normally rests on a skimmer well lip 44. Also positioned on the top plate 38 is a skimmer basket 48 which passes through a basket aperture 52 in the top plate 38 and rests on the top surface of the top plate 38 by means of a flange 54. As is conventional, the basket 48 can be removed for easy cleaning of the debris contained therein which is collected during the skimming action.

The vacuum hose 34 is coupled to a pump 56 which provides suction for the vacuum hose 34. In addition, an adjustable regulator valve 58 to which the hose 34 is connected, enables a portion of the suction produced by the pump 56 to be utilized to draw water through the basket 48 to complete the skimmer action. It should be noted that this dual use of the pump 56 for both vacuuming and skimming action also enables simultaneous use of a pool vacuum and the skimmer weir 12 to operate simultaneously.

Figure 3:
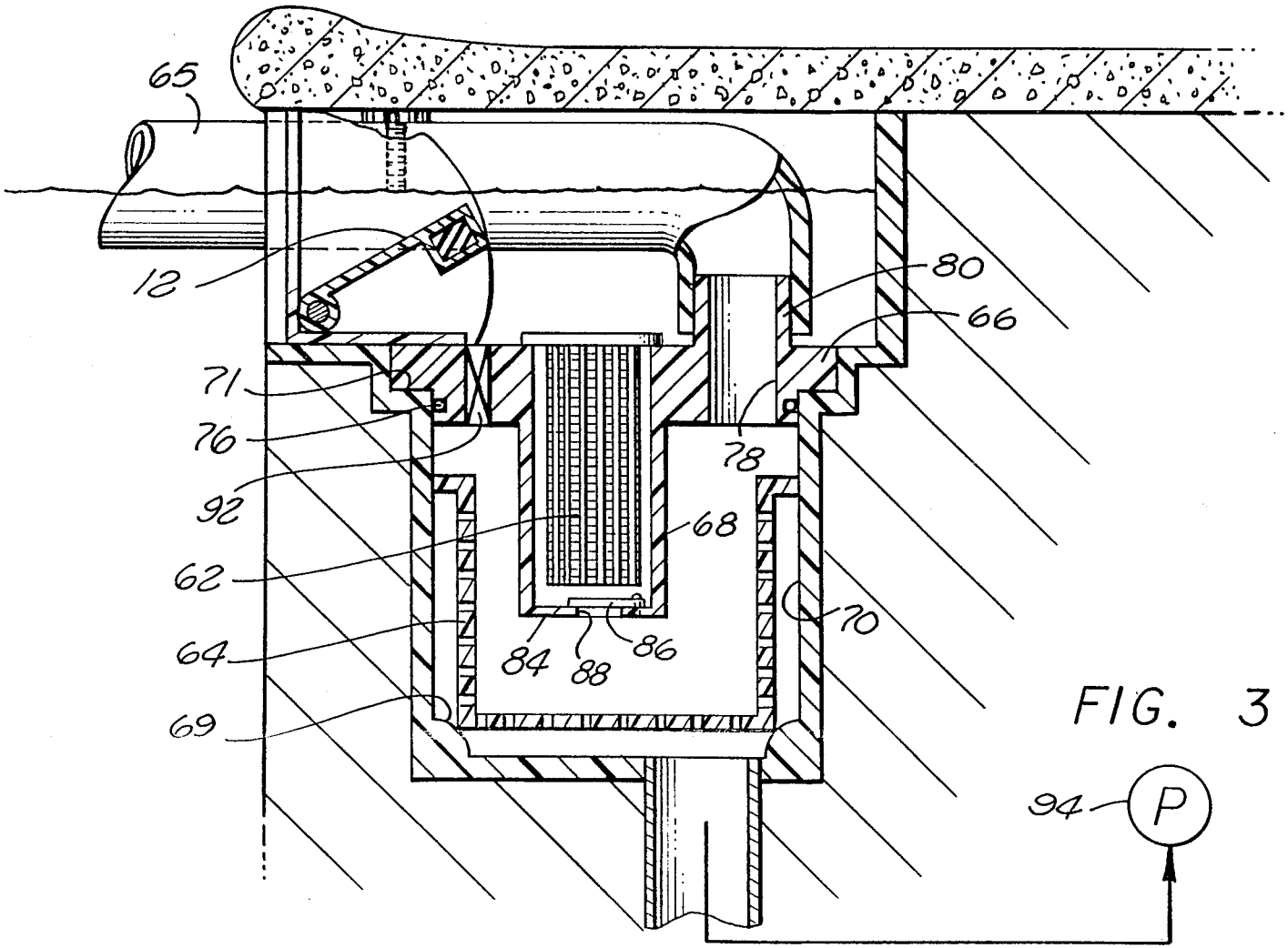
FIG. 3 is a cross-sectional view of an alternate arrangement of the swimming pool filter and vacuuming system.

The aforementioned description is normally utilized in situations where a leaf trap has been used in the pool and is connected to a vacuum hose 34 of FIG. 2. However, in situations where it is necessary or desirable to filter debris which is vacuumed through the vacuum hose and in order to prevent this debris from clogging the pump 56, an alternative arrangement shown in FIG. 3 is utilized. As shown in FIG. 3, inner and outer baskets 62 and 64, respectively, trap debris from the skimmer weir 12 and a hose 65. The outer basket 64 rests on ridges 69 formed on the bottom of a skimmer well 70. A top plate 66 rests on the skimmer well lip 71 and is sealed to the walls of the skimmer well by an O-ring seal 76. The inner basket 62 is concentrically positioned within a tube 68 which is integrally connected to the top plate 66.

The hose 65 extends through the passage plate aperture (not shown in FIG. 3) and is connected to a top plate flange 80. The bottom wall 84 of the tube 68 which is positioned intermediate the bottom walls of the inner and outer basket 62 and 64, respectively, and contains a valve which may be in a form of a rotating plate 86. The valve rotating plate 86 covers an aperture 88 formed in the bottom wall of the tube 68. Thus, when the pool pump is operative, suction to the hose 65 via the bottom outer vacuum basket 64, and the inner basket 62, respectively, is easily adjustable by rotating the valve plate 86.

An air relief valve 92 in the top plate 66 acts as a check valve to relieve back pressure when the pump 94 is turned off.

It should be noted that in the arrangement of FIG.3, the tube 68 and its integrally formed top plate 66 form a sealing arrangement, which separates the vacuum system associated with the inner basket 62 with that of the outer basket 64. The valve plate 86 enables adjustment of the amount of pump vacuum to be divided between the two systems.

Figure 4:
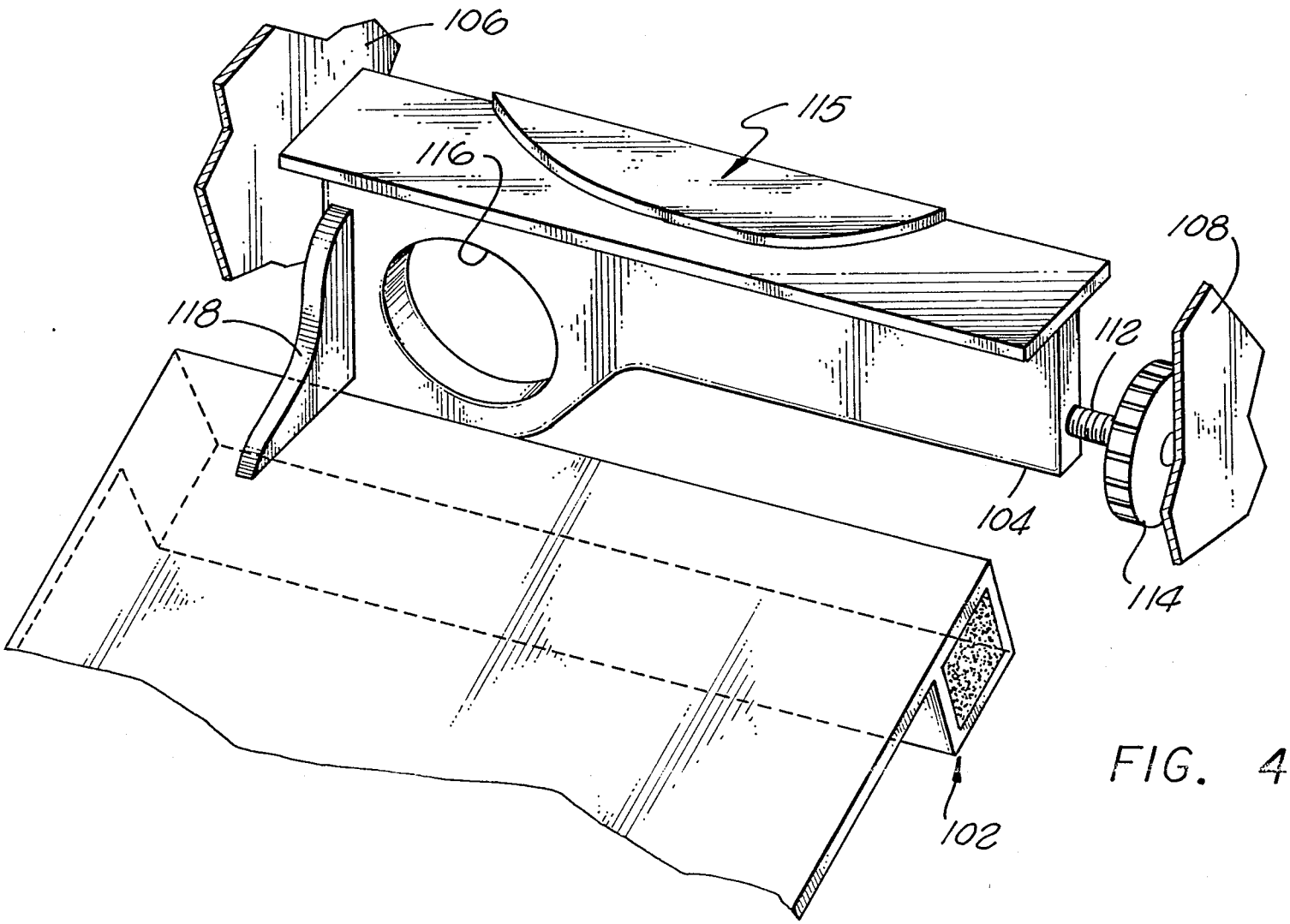
FIG. 4 is a partial perspective view of an alternate arrangement of a weir passage plate.

FIG. 4 illustrates an alternate arrangement for simultaneously allowing automatic vacuuming of a pool while continuing to allow a weir to operate. In FIG. 4, the skimmer weir 102 is the standard skimmer weir which is mounted transversely across the entire width of the pool passageway throat.

In order to allow the vacuum hose to pass through the passageway, a mounting plate 104 is positioned in a vertical plane between the side walls 106 and 108 of the passageway. The plate 104 is locked between the side walls by means of a screw 112 whose head 114 abuts the side wall 108. In addition, a top spacer plate 115 is positioned adjacent the top wall (not shown) of the passageway.

To limit interference between the weir 102 and the hose (not shown) which passes through the aperture 116 in the plate 104, a finger 118 extends forward from the plate and limits upward movement of the weir 102 to approximated 60% of the normally vertical position of the weir. While the finger 118 limits the weir 102 movement, it has been found there is sufficient weir movement to allow sufficient weir action to occur. In addition, there is no interference or touching between the weir and the vacuum hose which passes through the aperture 116.

I claim:

1. A swimming pool skimming and vacuuming system comprising:

a passage plate inserted in a water passage defining an opening interconnecting a skimmer well to a pool, said passage plate being secured along a plane transverse to the axis of said water passage, said passage plate being recessed in said water passage from the entrance interconnecting said pool and said skimmer well and having a skimmer weir integrally formed therewith for drawing off scum from the upper surface of said pool;

means for simultaneous skimming and vacuuming a pool comprising an aperture formed on one side of said passage plate connecting a vacuum hose from said pool to said skimmer well;

a weir basket positioned in said skimmer well for collecting scum from the weir;

a top mounting plate secured in said skimmer well and containing basket opening therein for enabling the top surface of said basket to be positioned on said plate;

a hose opening formed in said top mounting plate for connecting said vacuum hose thereto; and a regulator valve coupled to a pool suction pump for enabling the suction between the vacuum hose and the weir basket to be adjustably controlled.

2. A swimming pool skimming and vacuuming system comprising:

a passage plate positioned in a water passage defining an opening interconnecting a skimmer well to a pool, said passage plate having a skimmer weir integrally formed therewith for drawing off scum from the upper surface of said pool; said passage plate being recessed in said water passage from the entrance interconnecting said pool and said skimmer well;

means for simultaneous skimming and vacuuming a pool comprising an aperture formed on one side of said passage plate connecting a vacuum hose from said pool to said skimmer well;

a weir basket positioned in said skimmer well for collecting scum from the weir; and a regulator valve coupled to the pool suction pump for enabling the suction between the vacuum hose and the weir basket to be adjustable controlled.

3. A swimming pool element for limiting upward movement of a pivotally movable weir in a pool passageway while simultaneously enabling a vacuum hose to pass through said passageway comprising means for simultaneous skimming and vacuuming a pool including;

a mounting plate formed in a plane transverse to the axis of said passageway defining an opening interconnecting a skimmer well to a pool, said mounting plate being recessed in said passageway from the entrance interconnecting said pool and said skimmer well;

a finger member extending forward from said plate, said finger member limiting upward pivoting movement of said weir while simultaneously enabling said weir to movably operate,said weir structure including means for moving said weir from a generally horizontal position to an angular position which is an acute angle which respect to said horizontal plane; said weir abutting said finger member when in said angular position; and an aperture formed in said plate, said aperture positioned above the upper position of said weir during its movement and of sufficient size to enable a vacuum hose to pass therethrough.

4. A swimming pool skimming and vacuuming system comprising:

a passage plate inserted in a passage interconnecting a skimmer well to a pool, said passage plate being secured along a plane transverse to the axis of said water passage, said passage plate being recessed in said water passage from the entrance interconnecting said pool and said skimmer well and having a skimmer weir integrally formed therewith for drawing off scum from the upper surface of said pool; means for simultaneous skimming and vacuuming a pool including an aperture formed in said passage connecting a vacuum hose from said pool to said skimmer well;

a weir basket positioned in said skimmer well for collecting scum from the weir;

a top mounting plate secured in said skimmer well and containing basket opening therein for enabling the top surface of said basket to be positioned on said plate;

a hose opening formed in said top mounting plate for connecting said vacuum hose to be connected thereto;

a regulator valve coupled to a pool suction pump for enabling the suction between the vacuum hose and the weir basket to be adjustably controlled;

a vacuum basket positioned in said skimmer well for trapping debris from said vacuum hose; and a tube forming an extension of said top mounting plate, said weir basket being positioned internally of said tube and said vacuum basket being positioned external of said tube.

5. Apparatus in accordance with claim 4 wherein said top plate is sealed to the walls of said skimmer well, and wherein a regulator valve is positioned in said tube for adjusting the suction between said vacuum hose and said weir basket.

6. A swimming pool skimming and vacuuming system comprising:

a passage plate inserted in a plane transverse to the axis of a water passage defining an opening interconnecting a skimmer well to a pool, said passage plate having a skimmer weir integrally formed therewith for drawing off scum from the upper surface of said pool, said passage plate being secured along a plane transverse to the axis of said water passage, and being recessed in said water passage from the entrance interconnecting said pool and said skimmer well; and means for simultaneous skimming and vacuuming a pool comprising an aperture formed in on one side of said passage plate connecting a vacuum hose from said pool to said skimmer well.

7. Apparatus in accordance with claim 6 and further comprising a weir basket positioned in said skimmer well for collecting scum from said weir, a top mounting plate secured in said skimmer well and containing a basket opening therein for enabling the top surface of said basket to be positioned on said plate, a hose opening formed in said top mounting plate for enabling said vaccum hose to be connected thereto, and a regular valve coupled to a pool suction pump for enabling the suction between the said vacuum hose and weir basket to be adjustably controlled.

* * * * *